US009355795B2

(12) United States Patent
Green et al.

(10) Patent No.: US 9,355,795 B2
(45) Date of Patent: May 31, 2016

(54) M-BLADE ACTUATED SWITCH ASSEMBLY

(71) Applicant: HONEYWELL INTERNATIONAL INC., Morristown, NJ (US)

(72) Inventors: Mark Green, Asheville, NC (US); Steven Speece, Winnebago, IL (US); Brian Speldrich, Freeport, IL (US)

(73) Assignee: Honeywell International Inc., Morris Plains, NJ (US)

( * ) Notice: Subject to any disclaimer, the term of this patent is extended or adjusted under 35 U.S.C. 154(b) by 305 days.

(21) Appl. No.: 14/022,397

(22) Filed: Sep. 10, 2013

(65) Prior Publication Data

US 2015/0068879 A1 Mar. 12, 2015

(51) Int. Cl.

| | |
|---|---|
| ***H01H 5/00*** | (2006.01) |
| ***H01H 13/42*** | (2006.01) |
| ***H01H 13/18*** | (2006.01) |
| *H01H 5/22* | (2006.01) |

(52) U.S. Cl.

CPC ..... *H01H 13/42* (2013.01); *H01H 13/186* (2013.01); *H01H 5/22* (2013.01)

(58) Field of Classification Search

CPC ..... H01H 5/00; H01H 1/00; H01H 1/06; H01H 1/20; H01H 1/2025; H01H 1/22; H01H 1/26; H01H 1/30; H01H 1/32; H01H 3/00; H01H 3/02; H01H 3/12; H01H 3/04; H01H 3/18; H01H 3/20; H01H 3/22; H01H 3/24; H01H 3/26; H01H 3/28; H01H 3/30; H01H 13/00; H01H 13/20; H01H 13/26; H01H 13/36; H01H 13/40; H01H 13/44; H01H 13/46; H01H 13/50; H01H 2003/12; H01H 2003/463; H01H 2215/034; H01H 5/04; H01H 5/18; H01H 5/20; H01H 5/22; H01H 5/24; H01H 5/26; H01H 5/28; H01H 5/30

USPC ..... 200/468

See application file for complete search history.

(56) References Cited

U.S. PATENT DOCUMENTS

| | | | | |
|---|---|---|---|---|
| 4,796,355 | A * | 1/1989 | Burch | H01H 5/18 228/173.6 |
| 5,555,972 | A | 9/1996 | Schwab | |
| 5,790,010 | A | 8/1998 | Schwab | |

FOREIGN PATENT DOCUMENTS

| | | | |
|---|---|---|---|
| CA | 2341698 | A1 | 11/1999 |
| CA | 2184554 | C | 8/2006 |

* cited by examiner

*Primary Examiner* — Renee Luebke
*Assistant Examiner* — Anthony R Jimenez
(74) *Attorney, Agent, or Firm* — Conley Rose, P.C.; Kristin Jordan Harkins

(57) ABSTRACT

A switch assembly includes an M-blade snap spring, an actuation arm, and a switch. The M-blade snap spring exhibits snap-action movement between a first actuator position and a second actuator position. The switch is responsive to the snap-action movement of the M-blade to move between a first switch position and a second switch position. The actuation arm is configured to selectively cause the M-blade snap spring to move, via snap-action, between the first actuator position and the second actuator position, which in turn causes the switch to move between the first switch position and the second switch position, respectively.

16 Claims, 5 Drawing Sheets

M-BLADE ACTUATED SWITCH ASSEMBLY

TECHNICAL FIELD

The present invention generally relates to switches, and more particularly relates to a switch assembly that uses an M-blade as an actuation mechanism.

BACKGROUND

Electrical switches typically operate to open and close an electrical circuit by moving one or more contacts between contact positions. A switch that is used to control one circuit is known as a single pole switch. In many instances, two or more switches are to simultaneously energize or de-energize two or more devices. For such instances, a multi-pole switch arrangement may be used. Depending on the application, the difference in the timing between the on/off times of the switch poles (i.e., the "simultaneity") can be important and may be regulated as maximum specified values through various industry, agency or military standards. Many times, the specified simultaneity can be relatively difficult to achieve. This can be especially true when precision switches are needed with very precise and repeatable on/off positions and/or small differential travels (which is the difference in the on and off position). Low simultaneity in switch applications can be further complicated by slow switch actuation speeds.

Presently, multi-pole switch simultaneity is accomplished via three different techniques. One technique involves single, multi-pole switch designs having a single operating plunger and utilizing complex mechanisms to achieve simultaneity. However, these switches tend to be relatively large, which limits their potential usefulness. Furthermore, the mechanism complexity limits the level of precision that can be achieved in terms of on/off position repeatability and low differential travel.

A second technique that is used is ganging together two or more separate precision snap-action switches, each with their own operating plunger. A separate mechanism is provided to operate all the switches. The difficulty with this technique is that the individual switches must first be sorted to attain substantially identical on/off positions. This sorting operation can be relatively time-consuming and costly. Moreover, even with doing so, the level of simultaneity that can be achieved for both the on position and the off position remains limited because each individual switch has slightly different differential travels.

A third technique is similar to the second, in that two separate switches with a separate actuating mechanism are used. However, with this third technique, a single actuating mechanism is fitted with adjustment features, such as bendable tabs or adjustment screws. This can be relatively costly and, like the second technique, the level of simultaneity that can be achieved for both the on position and the off position remains limited.

Other potential concerns with presently known electrical switches include reliable control of low electrical loads and resistance to shock and vibration. Reliable control of low electrical loads implies that low electrical resistance is maintained when the switch is in the on position. The electrical resistance is largely a function of the contact force, which is the amount of force that is holding the switch contacts together. The higher and more stable the contact force, the lower and more stable the electrical resistance. Exposure to shock and vibration can cause the switch contacts to separate, resulting in unintended interruption of the electrical current flow. Good resistance to vibration and shock requires that the switch contacts remain in electrical contact. The higher and more stable the contact force, the better the shock and vibration resistance.

Hence there is a need for a single, relatively small-size, multi-pole switch with a single operating plunger and low differential travel that also has a relatively small simultaneity characteristic. There is also a need for a switch with higher and/or maintained contact forces during switch operation when the switch is in the on position and when the switch is exposed to shock or vibration. The present invention addresses at least these needs.

BRIEF SUMMARY

In one embodiment, a switch assembly includes an M-blade snap spring, an actuation arm, and a switch. The M-blade snap spring includes a closed end, a double-loop end, a first outer leg, a second outer leg, a first inner leg, a second inner leg, and a cross member. The double-loop end is disposed opposite the closed end and includes a first loop and a second loop. The first outer leg is coupled to the first inner leg to form the first loop of the double-loop end. The second outer leg is coupled to the second inner leg to form the second loop of the double-loop end. The cross member is coupled to the first outer leg and to the second outer leg to define the closed end. The first inner leg is spaced apart from the second inner leg. The actuation arm is coupled to, and includes a portion that extends between, the first and second inner legs. The portion is dimensioned to distort the M-blade snap spring such that the first and second inner legs are out of coplanar alignment with the first and second outer legs and the cross member, whereby the M-blade snap spring exhibits snap-action movement between a first actuator position and a second actuator position. The switch is coupled to the cross member, and is responsive to the snap-action movement of the M-blade to move between a first switch position and a second switch position. The actuation arm is configured to selectively move the first and second inner legs between a first inner leg position and a second inner leg position, to thereby cause the M-blade snap spring to move, via snap-action, between the first actuator position and the second actuator position, respectively, which in turn causes the switch to move between the first switch position and the second switch position, respectively.

In another embodiment, a switch assembly includes an M-blade snap spring, an actuation arm, an actuator, an actuation member, and a leaf spring. The M-blade snap spring includes a closed end, a double-loop end, a first outer leg, a second outer leg, a first inner leg, a second inner leg, and a cross member. The double-loop end is disposed opposite the closed end and includes a first loop and a second loop. The first outer leg is coupled to the first inner leg to form the first loop of the double-loop end. The second outer leg is coupled to the second inner leg to form the second loop of the double-loop end. The cross member is coupled to the first outer leg and to the second outer leg to define the closed end. The first inner leg is spaced apart from the second inner leg. The actuation arm is coupled to, and includes a portion that extends between, the first and second inner legs. The portion is dimensioned to distort the M-blade snap spring such that the first and second inner legs are out of coplanar alignment with the first and second outer legs and the cross member, whereby the M-blade snap spring exhibits snap-action movement between a first actuator position and a second actuator position. The actuator is disposed adjacent the actuation arm and is configured to selectively supply an actuation force to, and remove an actuation force from, the actuation arm. The actuation member is coupled to the cross member and is moveable therewith. The leaf spring extends through the actuation member and is configured, in response to movement of the actuation member, to move between a first switch position and a second switch position. The actuation arm is configured to selectively move the first and second inner legs between a first inner leg position and a second inner leg position, to thereby cause the M-blade snap spring to move, via snap-action, between the first actuator position and the second actuator position, respectively, whereby the actuation member moves and causes the leaf spring to move between the first switch position and the second switch position, respectively.

In yet another embodiment, a switch assembly includes an actuator housing, a switch housing, an M-blade snap spring, an actuation arm, a plurality of normally-closed contacts, a plurality of normally-open contacts, an actuation member, and a plurality of leaf springs. The switch housing is coupled to the actuator housing. The M-blade snap spring is coupled to and is disposed within the actuator housing and includes a closed end, a double-loop end, a first outer leg, a second outer leg, a first inner leg, a second inner leg, and a cross member. The double-loop end is disposed opposite the closed end and includes a first loop and a second loop. The first outer leg is coupled to the first inner leg to form the first loop of the double-loop end. The second outer leg is coupled to the second inner leg to form the second loop of the double-loop end. The cross member is coupled to the first outer leg and to the second outer leg to define the closed end. The first inner leg is spaced apart from the second inner leg. The actuation arm is coupled to and is disposed within the actuator housing. The actuation arm is coupled to, and includes a portion that extends between, the first and second inner legs. The portion is dimensioned to distort the M-blade snap spring such that the first and second inner legs are out of coplanar alignment with the first and second outer legs and the cross member, whereby the M-blade snap spring exhibits snap-action movement between a first actuator position and a second actuator position. The plurality of normally-closed contacts are coupled to and disposed within the switch housing, and the plurality of normally-open contacts are coupled to and disposed within the switch housing and are spaced apart from the normally-closed contacts. The actuation member is disposed partially within the actuator housing and the switch housing and is coupled to the cross member. The plurality of leaf springs is disposed within the switch housing and extends through a portion of the actuation member. Each leaf spring is configured to move between a first switch position and a second switch position, and each has a first end and a second end. The first end of each leaf spring is fixedly coupled to the switch housing. The second end of each leaf spring is electrically coupled to a different one of the normally-closed contacts when the M-blade snap spring is in the first actuator position, and the second end of each leaf spring is electrically coupled to a different one of the normally-open contacts when the M-blade snap spring is in the second actuator position. The actuation arm is configured to selectively move the first and second inner legs between a first inner leg position and a second inner leg position, to thereby cause the M-blade snap spring to move, via snap-action, between the first actuator position and the second actuator position, respectively, whereby the actuation member moves and causes each of the leaf springs to move between the first switch position and the second switch position, respectively.

Furthermore, other desirable features and characteristics of the switch assembly will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
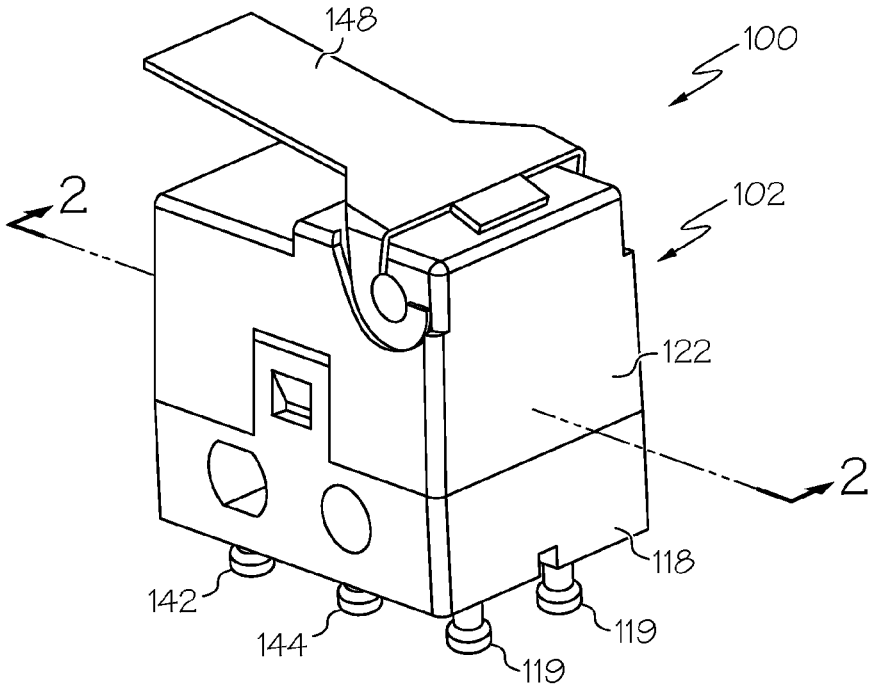
FIG. 1 is a plan view of one embodiment of a switch assembly.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims.

In this document, relational terms such as first and second, and the like may be used solely to distinguish one entity or action from another entity or action without necessarily requiring or implying any actual such relationship or order between such entities or actions. Moreover, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements. Furthermore, there is no intention to be bound by any expressed or implied theory presented in the preceding technical field, background, brief summary, or the following detailed description.

Referring now to FIGS. 1-4, various views of one exemplary embodiment of a switch assembly is depicted. The depicted switch assembly is a double-pole, double-throw switch assembly 100, which includes a housing assembly 102, an M-blade snap spring 104, an actuation arm 106, a switch 108, a plurality of normally-closed contacts 112, and a plurality of normally-open contacts 114. Before proceeding further, it is noted that although the switch assembly 100 depicted and described herein is a double-pole, double-throw, it could be configured and implemented as a single-pole switch or an N-pole switch (N>2), if needed or desired.

Returning to the description, the housing assembly 102 may be variously configured and implemented, but the depicted housing 102 includes an actuator housing 116, a switch housing 118, and a cover 122. The actuator housing 116 is coupled to the switch housing 118, and each is used to mount various ones of the switch components. The depicted cover 122 is coupled to the switch housing 118, and envelopes many of the switch components that will now be described.

The M-blade snap spring 104 is coupled to and is disposed within the actuator housing 116. The M-blade snap spring 104 is configured to exhibit snap-action movement between a first actuator position, which is the position depicted in FIG. 2, and a second actuator position, which is the position depicted in FIG. 3. The M-blade snap spring 104 may be variously configured and implemented. One particular configuration and implementation of the M-blade snap spring 104 is depicted in FIG. 5, and will now be described.

The depicted M-blade snap spring 104 includes a closed end 502, a double-loop end 504, a first outer leg 506, a second outer leg 508, a first inner leg 512, a second inner leg 514, and a cross member 516. The double-loop end 504 is disposed opposite the closed end 502 and includes a first loop 518 and a second loop 522. It is noted that although the depicted first and second loops 518, 522 are rounded, these loops could also be square. The first outer leg 506 is coupled to the first inner leg 512 to form the first loop 518 of the double-loop end 504. The second outer leg 508 is coupled to the second inner leg 514 to form the second loop 522 of the double-loop end 504. The cross member 516 is coupled to the first outer leg 506 and to the second outer leg 508 to define the closed end 502.

Figure 5:
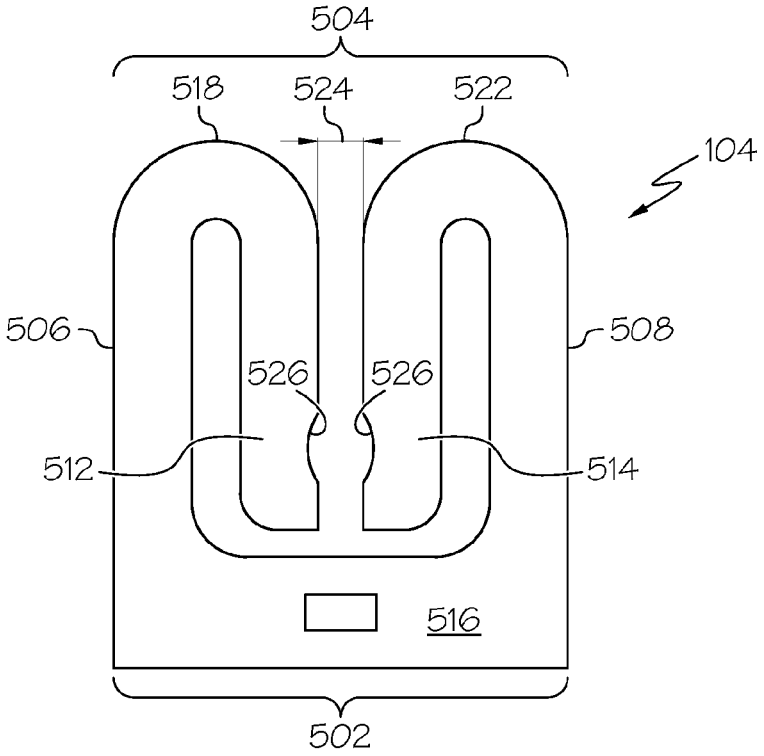
FIG. 5 is a top view of an M-blade that may be used to implement the switch depicted in FIGS. 1 and 2.

As FIG. 5 also depicts, the first inner leg 512 is spaced apart from the second inner leg 514 to define a gap 524. When the first and second inner legs 512, 514 are spread further apart to increase the width of the gap 524, the M-blade snap spring 104 is distorted, such that the first and second inner legs 512, 514 are out of coplanar alignment with the first and second outer legs 506, 508 and the cross member 516. As a result, the M-blade snap spring 104 exhibits snap-action movement between the first actuator position and the second actuator position.

In the depicted embodiment, the first and second inner legs 512, 514 are spread via mount hardware 124 (see FIGS. 2 and 3) that is coupled to the actuation arm 106. In particular, the first and second inner legs 512, 514 each have a locating recess 526 formed therein, and into which the mount hardware 124 is inserted. The mount hardware 124 is dimensioned to spread the first and second inner legs 512, 514 and distort the M-blade snap spring 104, as described above and depicted most clearly in FIG. 4. It will be appreciated that the mount hardware 124 that is used to distort the M-blade snap spring 104 may be variously implemented and configured, and may be implemented integrally with the actuation arm 106 or, as depicted, be implemented separate from the actuation arm 106 and then coupled thereto.

Returning to FIGS. 1-4, it is seen that the actuation arm 106, in addition to being coupled to the first and second inner legs 512, 514, is coupled to and disposed within the actuator housing 116. In the depicted embodiment, the actuation arm 106 is coupled at one end to the actuator housing 116 via suitable coupling hardware 126, and is coupled at another end to the first and second inner legs 512, 514 via the mount hardware 124 (or other suitable means). It will be appreciated that the actuation arm 106 may be variously configured and implemented. No matter its specific configuration, or the specific manner in which it is coupled to the actuator housing 116 and the first and second inner legs 512, 514, the actuation arm 106 is additionally configured to selectively move the first and second inner legs 512, 514 between a first inner leg position (see FIG. 2) and a second inner leg position (see FIG. 3), to thereby cause the M-blade snap spring 104 to move, via snap-action, between the first actuator position and the second actuator position, respectively, and thereby actuate the switch 108.

The switch 108 is coupled to the cross member 516 of the M-blade snap spring 104. The switch 108 is responsive to the snap-action movement of the M-blade snap spring 104 to move between a first switch position, which is the position depicted in FIG. 1, and a second switch position, which is the position depicted in FIG. 2. In particular, when the M-blade snap spring 104 moves, via snap-action, between the first actuator position and the second actuator position, the switch 108 moves between the first switch position and the second switch position, respectively.

The switch 108 may be variously configured to implement the above-described functionality, but in the depicted embodiment, the switch 108 includes an actuation member 128 and a plurality of leaf springs 132 (132-1, 132-2). The actuation member 128 is partially disposed within both the actuator housing 116 and the switch housing 118, and is coupled to the cross member 516. The leaf springs 132 are disposed within the switch housing 118, and each extends through a different one of a pair of slots 134 formed in the actuation member 128. Each leaf spring has a first end 136 and a second end 138. The first end 136 of each leaf spring 132 is fixedly coupled to the switch housing 118 via a common terminal 119, and the second end 138 of each leaf spring 132 is electrically coupled to a different one of the contacts 112, 114. In particular, the second ends 138 are electrically coupled to different ones of the normally-closed contacts 112 when the M-blade snap spring 104 is in the first actuator position, and are electrically coupled to different ones of the normally-open contacts 114 when the M-blade snap spring 104 is in the second actuator position.

As noted above, the switch assembly 100 additionally includes a plurality of normally-closed contacts 112 and a plurality of normally-open contacts 114. The normally-closed contacts 112 are each coupled to, and extend through, the switch housing 118 to a pair of first terminals 142, which allows the normally-closed contacts 112 to be electrically connected to external devices, circuits, or systems. The normally-open contacts 114 are spaced apart from the normally-closed contacts 112. The normally-open contacts 114 are also coupled to, and extend through, the switch housing 118 to a pair of second terminals 144-1, 144-2, which allows the normally-open contacts 114 to be electrically connected to external devices, circuits, or systems.

As FIGS. 1-4 further depict, the switch assembly 100 may additionally include an actuator 146 and a lever arm 148. The actuator 146 extends through the cover 122 and is disposed adjacent to the actuation arm 106. The lever arm 148 is rotationally coupled to the cover 122, and is disposed adjacent to the actuator 146. The lever arm 148 is configured to selectively supply an actuation force to, and remove an actuation force from, the actuator 146. The actuator 146 in turn supplies and removes the actuation force to and from the actuation arm 106, to thereby selectively move the M-blade snap spring 104, via snap-action, between the first actuator position and the second actuator position, respectively. Although the actuator 146 may be variously configured to implement this functionality, in the depicted embodiment it is implemented using a plunger-type device that extends through an opening in the cover 122, and contacts both the actuation arm 106 and the lever arm 148. The depicted lever arm 148, which may also be variously configured, may receive an input force from a non-illustrated external device, such as a motor or solenoid, for example, or it may receive an input force from a user. It will be appreciated that some embodiments may not include the lever arm 148. In such embodiments, the input force may be supplied directly to the actuator 146.

Figure 2:
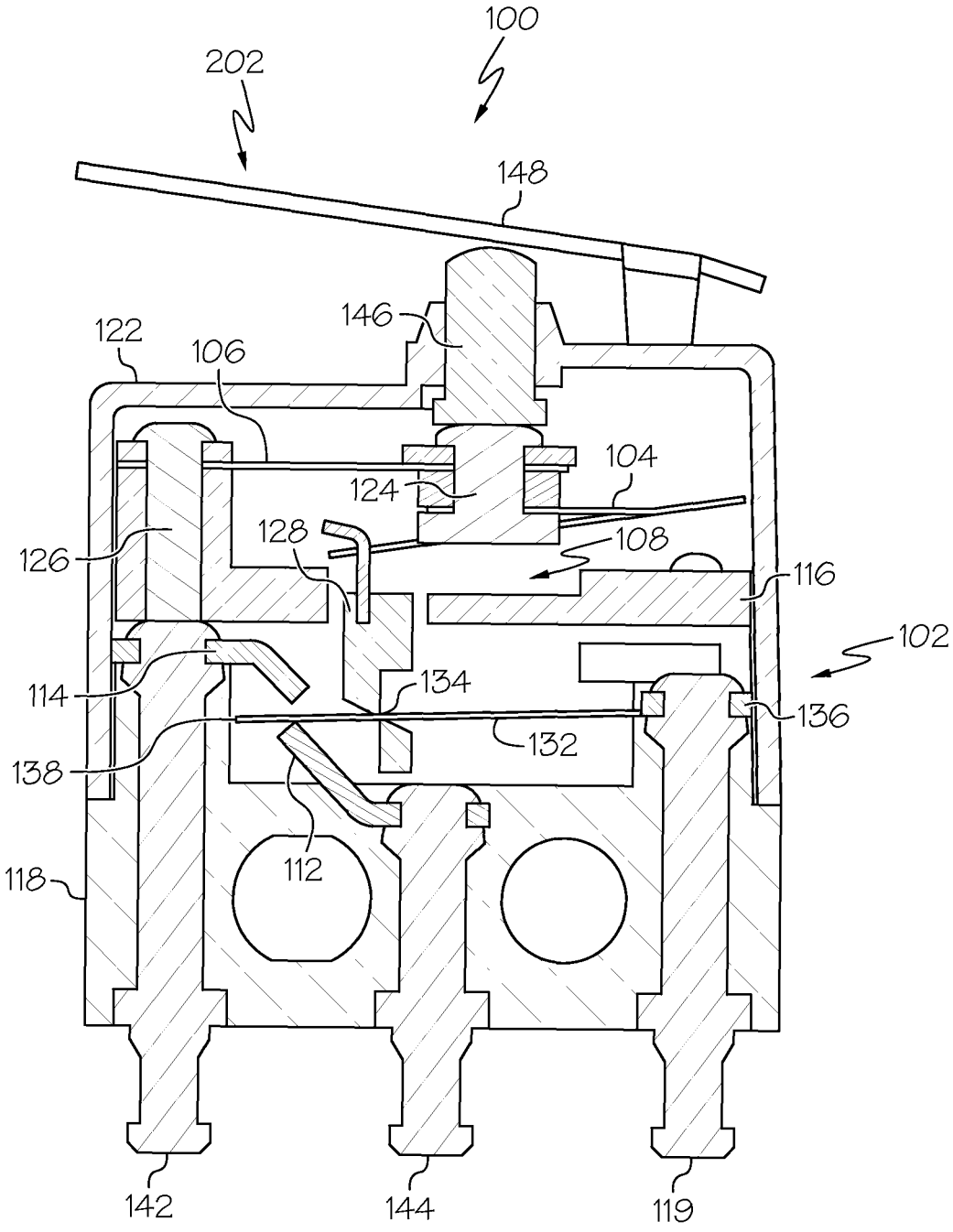
FIGS. 2 and 3 are cross-section views of the switch assembly taken along line 2-2 in FIG. 1, and with the switch assembly in a first switch position and a second switch position, respectively.
Figure 3:
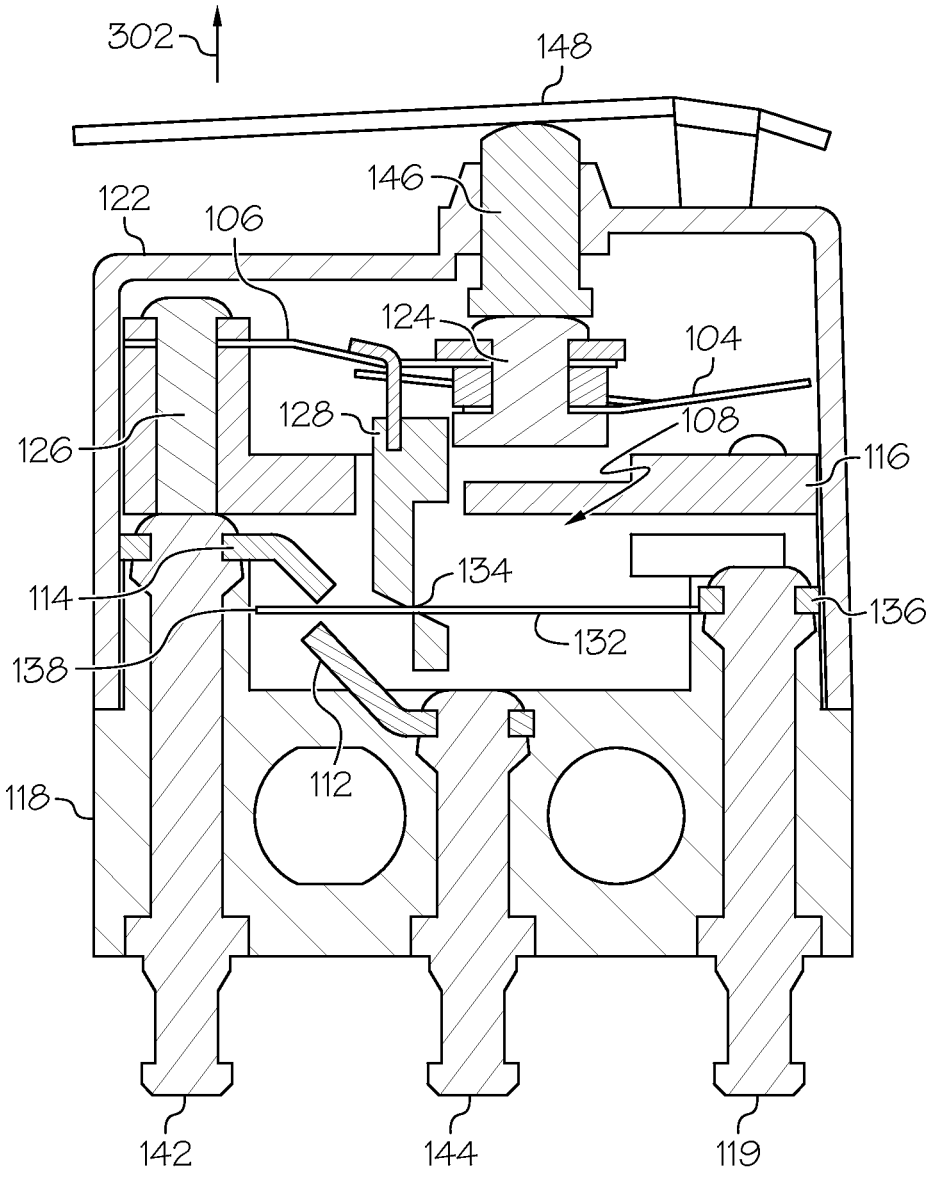
Figure 4:
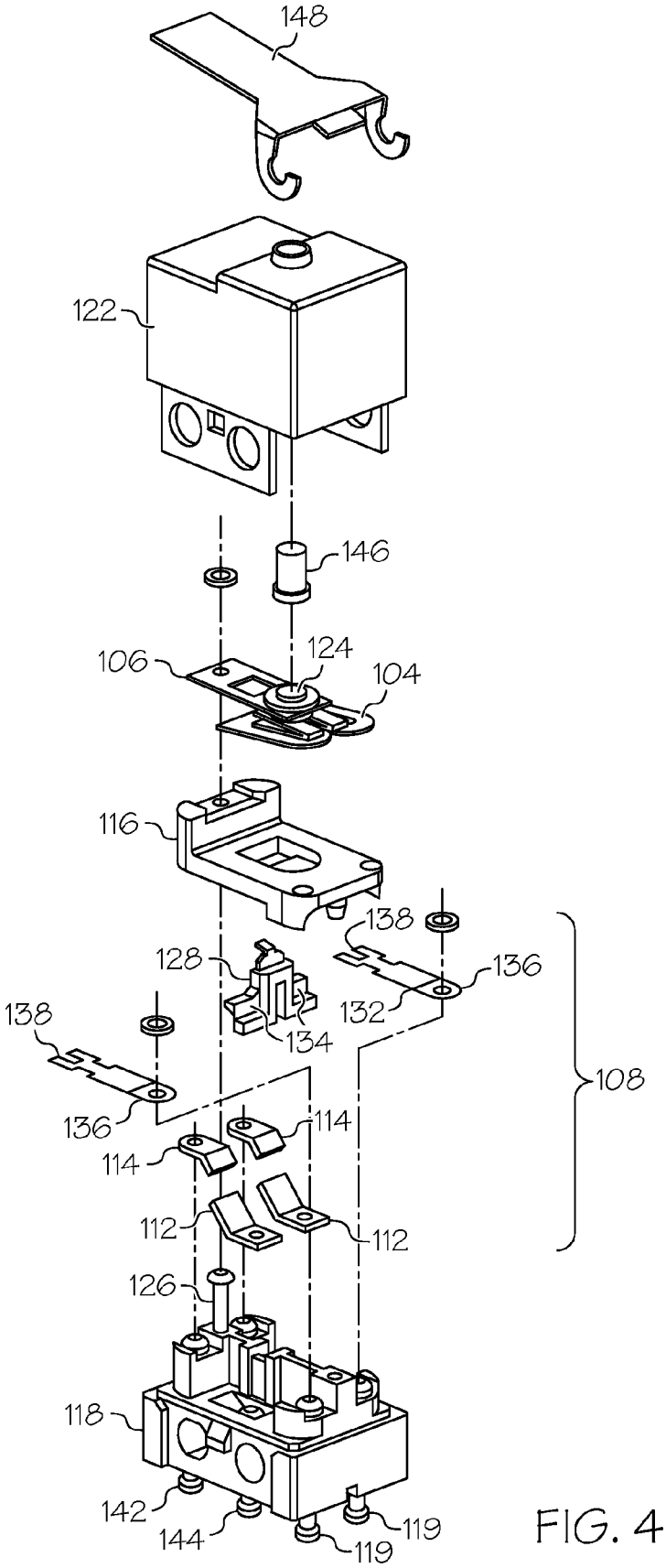
FIG. 4 is an exploded view of the switch assembly depicted in FIG. 1.

Having described the structure of the switch assembly 100, and generally described certain functions of the various components that comprise the switch assembly 100, its overall operation will now be described. The "normal" state of the switch assembly 100 is depicted in FIG. 2, when no (or insufficient) force is being supplied to the actuator 146 via, for example, the lever arm 148. In this state, the M-blade snap spring 104 is in the first actuator position, and the switch 108 is in the first switch position, which means the second ends 138 of the leaf springs 132 are electrically coupled to different ones of the normally-closed contacts 112.

When a force of sufficient magnitude is supplied to the actuator 146 in a first direction 202 via, for example, the lever arm 148, the actuator 146 pushes against the actuator arm 106, and thus causes the first and second inner legs 512, 514 of the M-blade snap spring 104 to also move in the first direction 202. When the first and second inner legs 512, 514 reach a first point, which may be referred to as the "operate point" or "snap-over point," the first and second outer legs 506, 508 snap in a second direction 302 (see FIG. 3), and move the M-blade snap spring 104 to the second actuator position. The first and second inner legs 512, 514 may continue to travel to the second inner leg position depicted in FIG. 3. Movement of the M-blade snap spring 104 to the second actuator position causes the actuation member 128 to move in the second direction 302. This in turn causes each of the leaf springs 132 to move from the first switch position to the second switch position, which means the second ends 138 of the leaf springs 132 are now electrically coupled to different ones of the normally-open contacts 114.

Thereafter, upon removal of the force from the actuator 146 (and lever arm 148), the first and second inner legs 512, 514 of the M-blade snap spring 104 will move in the second direction 302. When the first and second inner legs 512, 514 reach a second point, which may be referred to as the "return point," the first and second outer legs 506, 508 snap back in the first direction 202, and place the M-blade snap spring 104 back into the first actuator position, and the switch 108 back into the first switch position.

Figure 6:
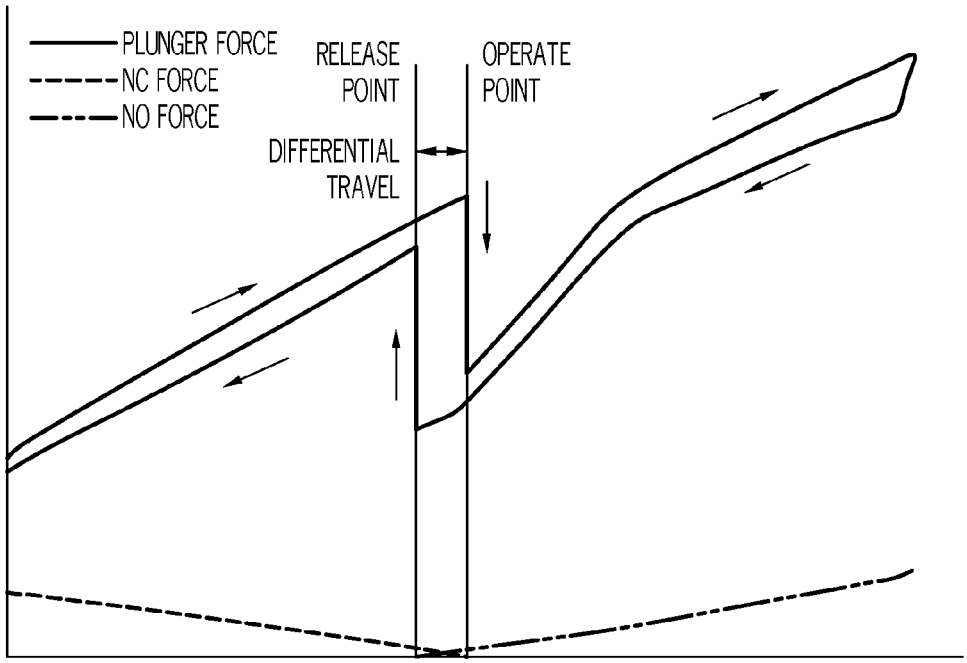
FIG. 6 depicts a graph of actuator force and contact force versus actuator travel for a conventional switch assembly.
Figure 7:
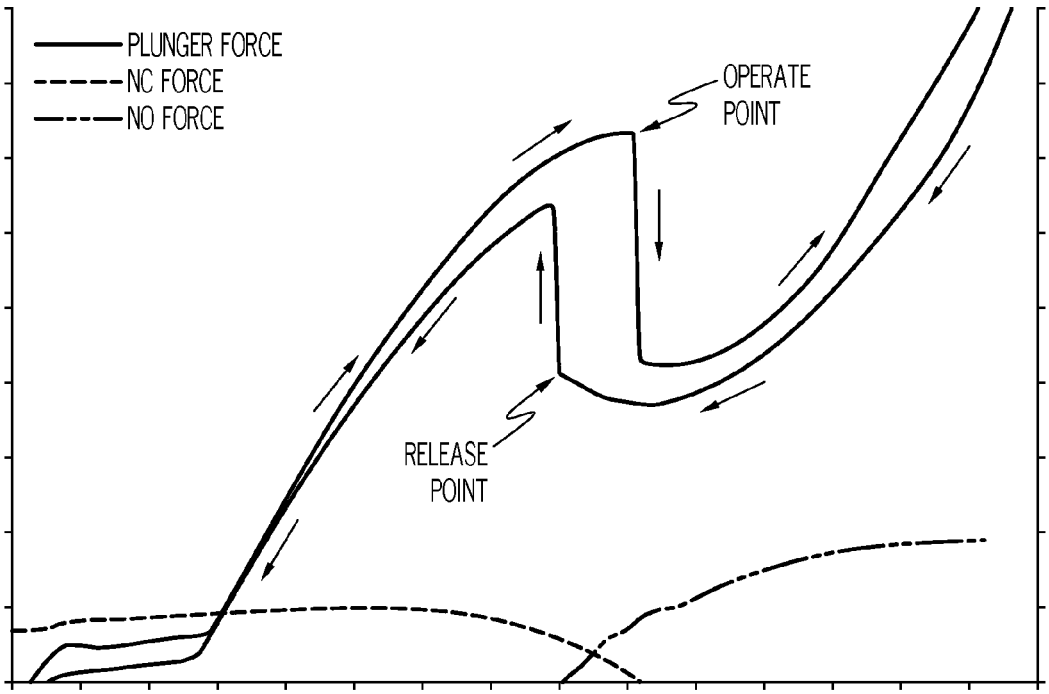
FIG. 7 depicts a graph of actuator force and contact force versus actuator travel for the switch assembly depicted in FIGS. 1-4.

The switch assembly 100 depicted and described herein uses the M-blade snap spring 104 as a snap-action actuator, rather than as a moveable contact as is done in presently known switch assemblies. There is no electrical contact associated with the M-blade snap spring 104. Hence, because the switch assembly 100 uses a common snap-action actuator to move the movable contacts (e.g., the leaf springs 132), the contacts will move from the normally-closed position to the normally-open position at a substantially identical point, thereby providing substantial simultaneity. In addition, the force deflection characteristics of the M-blade snap spring 104 provide a maintained force at the cross member 516 of the M-blade snap spring 104. This directly translates to a maintained contact force, which increases the load reliability and shock and vibration resistance. To more clearly illustrate the improved contact force, FIG. 6 depicts a graph of actuator force and contact force versus actuator travel for a conventional snap-action switch assembly, and FIG. 7 depicts a graph of actuator force and contact force versus actuator travel for the switch assembly 100 described herein.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A switch assembly, comprising:

an actuator housing;

an M-blade snap spring disposed within the actuator housing and including a closed end, a double-loop end, a first outer leg, a second outer leg, a first inner leg, a second inner leg, and a cross member, the double-loop end disposed opposite the closed end and including a first loop and a second loop, the first outer leg coupled to the first inner leg to form the first loop of the double-loop end, the second outer leg coupled to the second inner leg to form the second loop of the double-loop end, the cross member coupled to the first outer leg and to the second outer leg to define the closed end, the first inner leg spaced apart from the second inner leg;

an actuation arm disposed within the actuator housing and having a first end and a second end, the first end fixedly coupled to the actuator housing, the actuation arm extending in cantilever fashion from the actuator housing to the second end, the second end coupled to, and including a portion that extends between, the first and second inner legs, the portion dimensioned to distort the M-blade snap spring such that the first and second inner legs are out of coplanar alignment with the first and second outer legs and the cross member, whereby the M-blade snap spring exhibits snap-action movement between a first actuator position and a second actuator position; and a switch coupled to the cross member, the switch responsive to the snap-action movement of the M-blade to move between a first switch position and a second switch position, wherein:

the actuation arm is configured to selectively move the first and second inner legs between a first inner leg position and a second inner leg position, to thereby cause the M-blade snap spring to move, via snap-action, between the first actuator position and the second actuator position, respectively, which in turn causes the switch to move between the first switch position and the second switch position, respectively.

2. The switch assembly of claim 1, wherein the switch comprises:

an actuation member coupled to the cross member and movable therewith; and a leaf spring coupled to the actuation member and configured, in response to movement of the actuation member, to move between the first and second switch positions.

3. The switch assembly of claim 2, further comprising:

a normally-closed contact disposed to be electrically connected to the leaf spring when the M-blade snap spring is in the first actuator position; and a normally-open contact spaced apart from the normally-closed contact, and disposed to be electrically connected to the leaf spring when the M-blade snap spring is in the second actuator position.

4. The switch assembly of claim 1, further comprising:

an actuator disposed adjacent the actuation arm and configured to selectively supply an actuation force to, and remove the actuation force from, the actuation arm.

5. The switch assembly of claim 1, further comprising:

a switch housing having the switch coupled thereto, the switch housing coupled to the actuator housing.

6. The switch assembly of claim 5, wherein the switch comprises:

a normally-closed contact coupled to the switch housing;

a normally-open contact coupled to the switch housing and spaced apart from the normally-closed contact;

an actuation member coupled to the cross member; and a leaf spring extending through a portion of the actuation member and configured to move between the first switch position and the second switch position, the leaf spring having a first end and a second end, the first end fixedly coupled to the switch housing, the second end electrically coupled to the normally-closed contact when the M-blade snap spring is in the first actuator position, and electrically coupled to the normally-open contact when the M-blade snap spring is in the second actuator position.

7. The switch assembly of claim 5, further comprising:

a cover coupled to the switch housing and the actuator housing;

an actuator extending through the cover and disposed adjacent the actuation arm; and a lever arm rotationally coupled to the cover and disposed adjacent the actuator, the lever arm configured to selectively supply an actuation force to, and remove an actuation force from, the actuator.

8. The switch assembly of claim 5, wherein the switch comprises:

a plurality of normally-closed contacts coupled to the switch housing;

a plurality of normally-open contacts coupled to the switch housing and spaced apart from the normally-closed contacts;

an actuation member coupled to the cross member and movable therewith; and a plurality of leaf springs, each leaf spring extending through a portion of the actuation member and configured, in response to movement of the actuation member, to move between the first switch position and the second switch position, each leaf spring having a first end and a second end, the first end of each leaf spring fixedly coupled to the switch housing, the second end of each leaf spring electrically coupled to a different one of the normally-closed contacts when the M-blade snap spring is in the first actuator position, and electrically coupled to a different one of the normally-open contacts when the M-blade snap spring is in the second actuator position.

9. A switch assembly, comprising:

an M-blade snap spring including a closed end, a double-loop end, a first outer leg, a second outer leg, a first inner leg, a second inner leg, and a cross member, the double-loop end disposed opposite the closed end and including a first loop and a second loop, the first outer leg coupled to the first inner leg to form the first loop of the double-loop end, the second outer leg coupled to the second inner leg to form the second loop of the double-loop end, the cross member coupled to the first outer leg and to the second outer leg to define the closed end, the first inner leg spaced apart from the second inner leg;

an actuation arm coupled to, and including a portion that extends between, the first and second inner legs, the portion dimensioned to distort the M-blade snap spring such that the first and second inner legs are out of coplanar alignment with the first and second outer legs and the cross member, whereby the M-blade snap spring exhibits snap-action movement between a first actuator position and a second actuator position;

an actuator disposed adjacent the actuation arm and configured to selectively supply an actuation force to, and remove an actuation force from, the actuation arm;

an actuation member coupled to the cross member and moveable therewith; and a leaf spring extending through the actuation member and configured, in response to movement of the actuation member, to move between a first switch position and a second switch position, wherein:

the actuation arm is configured to selectively move the first and second inner legs between a first inner leg position and a second inner leg position, to thereby cause the M-blade snap spring to move, via snap-action, between the first actuator position and the second actuator position, respectively, whereby the actuation member moves and causes the leaf spring to move between the first switch position and the second switch position, respectively.

10. The switch assembly of claim 9, further comprising:

a normally-closed contact disposed to be electrically connected to the leaf spring when the M-blade snap spring is in the first actuator position; and a normally-open contact spaced apart from the normally-closed contact, and disposed to be electrically connected to the leaf spring when the M-blade snap spring is in the second actuator position.

11. The switch assembly of claim 9, further comprising:

a switch housing having the switch coupled thereto.

12. The switch assembly of claim 11, further comprising:

an actuator housing coupled to the switch housing, the actuator housing having the M-blade snap spring and the actuation arm coupled thereto.

13. The switch assembly of claim 11, wherein the switch comprises:

a normally-closed contact coupled to the switch housing;

a normally-open contact coupled to the switch housing and spaced apart from the normally-closed contact;

an actuation member coupled to the cross member; and a leaf spring extending through a portion of the actuation member and configured to move between the first switch position and the second switch position, the leaf spring having a first end and a second end, the first end fixedly coupled to the switch housing, the second end electrically coupled to the normally-closed contact when the M-blade snap spring is in the first actuator position, and electrically coupled to the normally-open contact when the M-blade snap spring is in the second actuator position.

14. The switch assembly of claim 11, further comprising:

a cover coupled to the switch housing and the actuator housing;

an actuator extending through the cover and disposed adjacent the actuation arm; and a lever arm rotationally coupled to the cover and disposed adjacent the actuator, the lever arm configured to selectively supply an actuation force to, and remove the actuation force from, the actuator.

15. A switch assembly, comprising:

an actuator housing;

a switch housing coupled to the actuator housing;

an M-blade snap spring coupled to and disposed within the actuator housing and including a closed end, a double-loop end, a first outer leg, a second outer leg, a first inner leg, a second inner leg, and a cross member, the double-loop end disposed opposite the closed end and including a first loop and a second loop, the first outer leg coupled to the first inner leg to form the first loop of the double-loop end, the second outer leg coupled to the second inner leg to form the second loop of the double-loop end, the cross member coupled to the first outer leg and to the second outer leg to define the closed end, the first inner leg spaced apart from the second inner leg;

an actuation arm coupled to and disposed within the actuator housing, the actuation arm coupled to, and including a portion that extends between, the first and second inner legs, the portion dimensioned to distort the M-blade snap spring such that the first and second inner legs are out of coplanar alignment with the first and second outer legs and the cross member, whereby the M-blade snap spring exhibits snap-action movement between a first actuator position and a second actuator position;

a plurality of normally-closed contacts coupled to and disposed within the switch housing;

a plurality of normally-open contacts coupled to and disposed within the switch housing and spaced apart from the normally-closed contacts;

an actuation member disposed partially within the actuator housing and the switch housing and coupled to the cross member; and a plurality of leaf springs disposed within the switch housing and extending through a portion of the actuation member, each leaf spring configured to move between a first switch position and a second switch position, each leaf spring having a first end and a second end, the first end of each leaf spring fixedly coupled to the switch housing, the second end of each leaf spring electrically coupled to a different one of the normally-closed contacts when the M-blade snap spring is in the first actuator position, the second end of each leaf spring electrically coupled to a different one of the normally-open contacts when the M-blade snap spring is in the second actuator position, wherein:

the actuation arm is configured to selectively move the first and second inner legs between a first inner leg position and a second inner leg position, to thereby cause the M-blade snap spring to move, via snap-action, between the first actuator position and the second actuator position, respectively, whereby the actuation member moves and causes each of the leaf springs to move between the first switch position and the second switch position, respectively.

16. The switch assembly of claim 15, further comprising:

a cover coupled to the switch housing and the actuator housing;

an actuator extending through the cover and disposed adjacent the actuation arm; and a lever arm rotationally coupled to the cover and disposed adjacent the actuator, the lever arm configured to selectively supply an actuation force to, and remove the actuation force from, the actuator.

* * * * *